US007794383B2

(12) United States Patent
Tetsu et al.

(10) Patent No.: US 7,794,383 B2
(45) Date of Patent: Sep. 14, 2010

(54) CENTRIFUGAL SEPARATOR WITH ISOLATED ROTOR PART

(75) Inventors: Kenichi Tetsu, Hitachinaka (JP); Masaharu Aizawa, Hitachinaka (JP); Katsunori Akatsu, Hitachinaka (JP); Yoshinori Tobita, Hitachinaka (JP); Yukiyoshi Maehara, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 164 days.

(21) Appl. No.: 12/141,156

(22) Filed: Jun. 18, 2008

(65) Prior Publication Data

US 2008/0251436 A1 Oct. 16, 2008

Related U.S. Application Data

(62) Division of application No. 10/965,871, filed on Oct. 18, 2004, now Pat. No. 7,396,324.

(30) Foreign Application Priority Data

Oct. 17, 2003 (JP) ..... P2003-357363
Oct. 17, 2003 (JP) ..... P2003-357451

(51) Int. Cl.
*B04B 13/00* (2006.01)
*B04B 15/02* (2006.01)
*B04B 15/08* (2006.01)

(52) U.S. Cl. ..... 494/7; 494/14; 494/60; 494/61

(58) Field of Classification Search ..... 494/7–10, 494/16–21, 13–14, 60–61; 700/273; 422/72; 210/85, 143, 360.1–380.3
See application file for complete search history.

(56) References Cited

U.S. PATENT DOCUMENTS 3,007,629 A * 11/1961 Boyland ..... 494/42
3,108,955 A * 10/1963 Boyland ..... 494/74
3,430,849 A * 3/1969 Nunley et al. ..... 494/12

(Continued)

FOREIGN PATENT DOCUMENTS

EP 0344453 12/1989

(Continued)

OTHER PUBLICATIONS

Centrifuges 2002-2003, Hitachi, Scientific Instruments Division of Hitachi Koki Co., Ltd., Published Mar. 2002.

*Primary Examiner*—Charles E Cooley
(74) *Attorney, Agent, or Firm*—Antonelli, Terry, Stout & Kraus, LLP.

(57) ABSTRACT

A centrifugal separator includes a rotator part that separates a liquid sample and has a rotor and a drive part. The rotor receives a liquid sample therein and rotates to separate the liquid sample. The drive part drives the rotor to rotate. A controller part controls operations of the rotator part which is mounted in a rotator casing. A controller casing which is separate from the rotator casing mounts the controller part, and the controller part is connected via a drive wire to the drive part in the rotator part. The rotor casing is disposed at a clean room, the controller casing is disposed outside the clean room, and the drive wire passes through a wall of the clean room via an air-tight sealing mechanism.

11 Claims, 9 Drawing Sheets

U.S. PATENT DOCUMENTS

| | | | | |
|---|---|---|---|---|
| 3,501,091 | A * | 3/1970 | Yoshitoshi et al. | 494/25 |
| 4,244,513 | A * | 1/1981 | Fayer et al. | 494/10 |
| 4,822,331 | A | 4/1989 | Taylor | |
| 4,903,191 | A * | 2/1990 | Fries | 700/3 |
| 5,287,265 | A * | 2/1994 | Hall et al. | 700/83 |
| 5,582,726 | A * | 12/1996 | Feller et al. | 210/232 |
| 5,675,519 | A * | 10/1997 | Yotsuyanagi et al. | 703/6 |
| 5,721,676 | A * | 2/1998 | Bolden et al. | 700/3 |
| 5,865,718 | A * | 2/1999 | Chan | 494/10 |
| 5,871,435 | A * | 2/1999 | Numata et al. | 494/7 |
| 6,408,703 | B2 * | 6/2002 | Gerteis | 73/865 |
| 6,679,821 | B1 * | 1/2004 | Numata et al. | 494/10 |
| 7,144,361 | B2 * | 12/2006 | Aizawa et al. | 494/38 |
| 7,168,571 | B2 * | 1/2007 | Gerteis et al. | 210/372 |
| 7,396,324 | B2 * | 7/2008 | Tetsu et al. | 494/7 |
| 7,591,775 | B2 * | 9/2009 | Tobita et al. | 494/14 |
| 2002/0056672 | A1 * | 5/2002 | Lyle et al. | 210/94 |
| 2003/0018289 | A1 * | 1/2003 | Ng et al. | 604/6.01 |
| 2003/0114289 | A1 * | 6/2003 | Merino et al. | 494/37 |
| 2003/0199378 | A1 * | 10/2003 | Saviano | 494/11 |
| 2003/0199379 | A1 * | 10/2003 | Schneider et al. | 494/11 |
| 2004/0108281 | A1 * | 6/2004 | Gerteis et al. | 210/781 |
| 2004/0214711 | A1 * | 10/2004 | Aizawa et al. | 494/79 |
| 2005/0107235 | A1 * | 5/2005 | Tetsu et al. | 494/10 |
| 2005/0153823 | A1 * | 7/2005 | Fujimaki et al. | 494/7 |
| 2006/0009341 | A1 * | 1/2006 | Tobita et al. | 494/14 |
| 2006/0175245 | A1 * | 8/2006 | Gerteis et al. | 210/372 |
| 2007/0149378 | A1 * | 6/2007 | Takahashi et al. | 494/1 |
| 2008/0251436 | A1 * | 10/2008 | Tetsu et al. | 210/145 |
| 2009/0239729 | A1 * | 9/2009 | Tobita et al. | 494/14 |
| 2010/0075823 | A1 * | 3/2010 | Toi et al. | |

FOREIGN PATENT DOCUMENTS

| | | | |
|---|---|---|---|
| EP | 344453 | A2 * | 12/1989 |
| JP | 125179 | | 2/1938 |
| JP | 48-28863 | | 9/1973 |
| JP | S55-159752 | | 11/1980 |
| JP | 59-32966 | | 2/1984 |
| JP | 61-293567 | | 12/1986 |
| JP | 63-224499 | | 9/1988 |
| JP | 2-131154 | | 5/1990 |
| JP | 2290267 | | 11/1990 |
| JP | 3-61886 | | 3/1991 |
| JP | 3-34847 | | 4/1991 |
| JP | 5023618 | | 2/1993 |
| JP | 7-502422 | | 3/1995 |
| JP | 7-106328 | | 11/1995 |
| JP | 8-141440 | | 6/1996 |
| JP | 10-511489 | | 11/1998 |
| JP | 11347453 | | 12/1999 |
| JP | 2000-024551 | | 1/2000 |
| JP | 2000-024552 | | 1/2000 |
| JP | 2000-246147 | | 9/2000 |
| JP | 2003-126732 | | 5/2003 |
| JP | 2004-532094 | | 10/2004 |
| JP | 2006021121 | A * | 1/2006 |
| WO | WO 97/14998 | | 4/1997 |
| WO | WO 02/062484 | | 8/2002 |

* cited by examiner

CENTRIFUGAL SEPARATOR WITH ISOLATED ROTOR PART

CROSS REFERENCE TO RELATED APPLICATION

This application is a divisional application of U.S. Ser. No. 10/965,871, filed Oct. 18, 2004, now U.S. Pat. No. 7,396,324, the contents of which are incorporated herein by reference.

BACKGROUND OF THE INVENTION

1. Field of the Invention

The present invention relates to a centrifugal separator for performing centrifugation on a liquid sample to separate components in the liquid sample.

2. Description of Related Art

Centrifugal separators are used for separating components, such as viruses, cultured cells, or cultured bacteria, from a liquid sample, such as ingredients used in vaccines and medicines. The centrifugal separators have been proposed by Japanese examined utility model application publication No. SHO-48-28863, Japanese examined patent application publication No. HEI-7-106328, and Japanese unexamined patent application publications Nos. 2003-126732, HEI-5-23618, HEI-11-347453, 2000-24551, and 2000-24552. Several types of centrifuge separators have also been proposed by Hitach Koki Co., Ltd. as described in their catalogue entitled "2002-2003 CENTRIFUGES".

SUMMARY OF THE INVENTION

An object of the present invention is to provide an improved centrifugal separator that can enhance work efficiency for performing centrifugation.

Another object of the present invention is to provide an improved centrifugal separator that can enhance safety for performing centrifugation.

In order to attain the above and other objects, the present invention provides a centrifugal separator including: a rotator part; a controller part; a first control panel; and a second control panel. The rotator part separates a liquid sample. The rotator part includes a rotor and a drive part. The rotor receives a liquid sample therein and rotates to separate the liquid sample. The drive part drives the rotor to rotate. The controller part controls operations of the rotator part. The first control panel is connected to the controller part.

According to another aspect, the present invention provides a centrifugal separator including: a rotator part; and a controller part. The rotator part is located in a room isolated from outside and separates a liquid sample. The rotator part includes: a cylindrical rotor; a chamber part; and a drive part. The cylindrical rotor receives the liquid sample and, rotates to separate the liquid sample. The chamber part accommodates the rotor therein. The drive part drives the rotor to rotate. The controller part is disposed outside the room and controls driving of the drive part.

BRIEF DESCRIPTION OF THE DRAWINGS

The above and other objects, features and advantages of the invention will become more apparent from reading the following description of the preferred embodiments taken in connection with the accompanying drawings in which:

FIG. 3(*b*) is an enlarged view illustrating how one first electric wire cable is electrically connected with a second electric wire cable via first and second sealing members;

FIG. 3(*c*) is an enlarged view illustrating how one first pipe is fluidly communicated with a second pipe via a third sealing member;

DETAILED DESCRIPTION OF THE PREFERRED EMBODIMENTS

Figure 1:
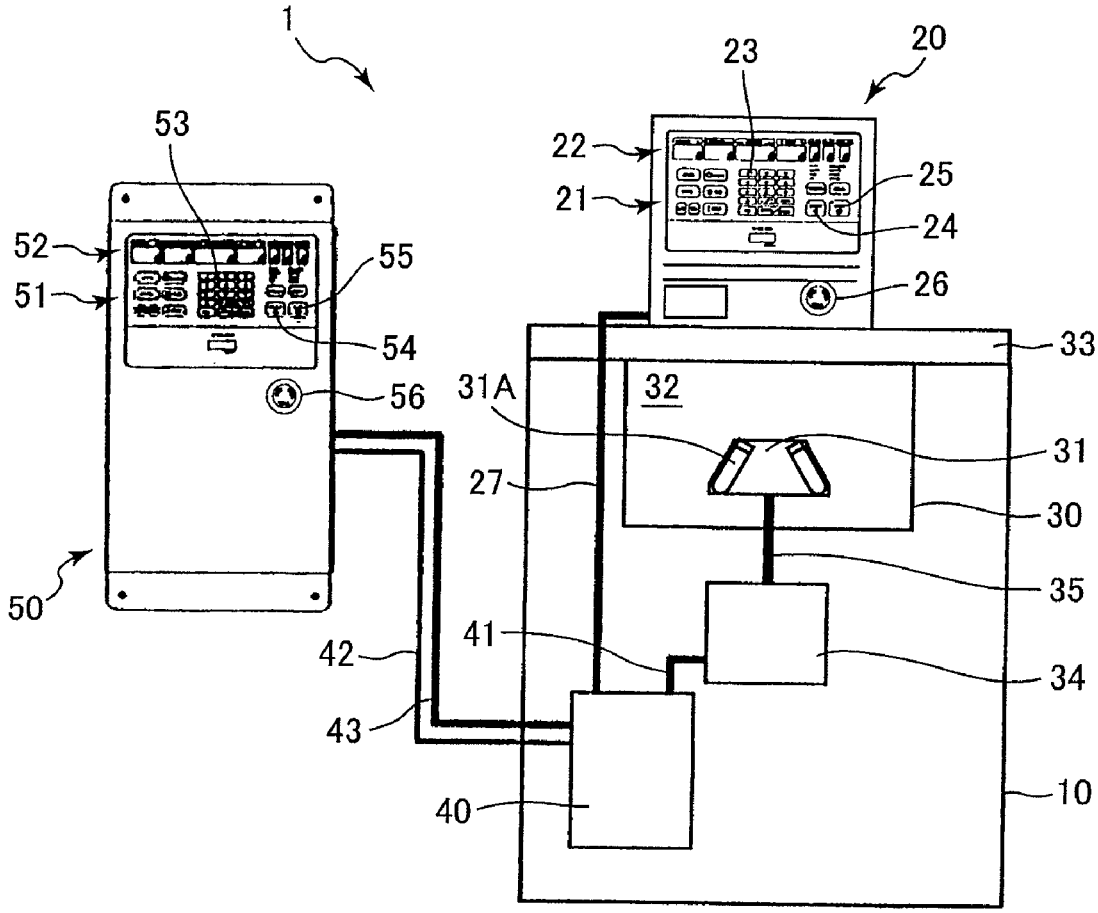
FIG. 1 is an explanatory diagram showing a centrifugal separator according to a first embodiment of the present invention.

A centrifugal separator according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts of the centrifugal separator when the centrifugal separator is disposed in an orientation in which it is intended to be used.

First Embodiment

A centrifugal separator 1 according to a first embodiment of the present invention will be described with reference to FIG. 1.

As shown in FIG. 1, the centrifugal separator 1 has a casing 10 forming the main body of the centrifugal separator 1. The casing 10 accommodates a rotator part 30 for separating components in a sample liquid, and a controller part 40 for controlling the rotator part 30. The centrifugal separator 1 also includes a first control panel 20 disposed on top of the casing 10 for setting operating conditions for the rotator part 30, and a second control panel 50 disposed in a location separate from the casing 10 and capable of setting the operating conditions for the rotator part 30 in the same way as the first control panel 20.

The rotator part 30 includes a rotor 31 for separating components in the sample liquid, and a rotor chamber 32 in which the rotor 31 is disposed. A door 33 configuring part of the casing 10 is provided on top of the rotor chamber 32, sealing the rotator chamber 32. The rotator part 30 is also provided with a drive unit 34 for driving the rotor 31 to rotate around its rotational axis. The driving force of the drive unit 34 is transferred to the rotor 31 via a drive shaft 35.

The rotor 31 of this embodiment is a so-called angle rotor. The rotor 31 is mounted on the drive shaft 35 with its rotational axis being aligned with the drive shaft 35. Several test tubes 31A are mounted in the rotor 31. In the rotor 31, each test tube 31A is disposed at a predetermined angle with respect to the rotational axis of the rotor 31. Each test tube 31A is filled with a liquid sample. When the rotor 31 is driven by the drive shaft 35 to rotate around its rotational axis, components in the liquid sample are separated due to a centrifugal force.

The first control panel 20 is disposed on top of the casing 10. The first control panel 20 includes a first operating part 21 and a first display unit 22. The first operating part 21 is for enabling a user to set operating conditions for the rotor 31. Representative examples of the operating conditions include: a desired rotating speed, at which the rotor 31 is desired to be rotated; and a desired operation period of time (a period of time, during which the rotor 31 is desired to be rotated). The first display unit 22 is for displaying the operating conditions and the operating status of the rotator part 30.

The first operating part 21 includes a first keypad 23 for entering the operating conditions for the rotor 31, and a first start switch 24 and first stop switch 25 for starting and stopping operations of the rotor 31. After setting operating conditions using the first operating part 21, the user can start up the rotator part 30 by pressing the first start switch 24 and stop the rotator part 30 by pressing the first stop switch 25. The first display unit 22 displays the operating conditions set by the first operating part 21, as well as the operating status of the rotator part 30 after operation begins, that is, after the rotor 31 starts rotating. The operating status of the rotator part 30 includes: the rotating speed, at which the rotor 31 is presently rotating; sample temperature; a period of time elapsed after the rotor 31 has started rotating; and alarms. The first control panel 20 is also provided with a first emergency stop switch 26. By pressing the first emergency stop switch 26, the user can immediately stop the operation of the rotator part 30, the first operating part 21, and a second operating part 51 (described later) in the second control panel 50. The first control panel 20 is connected to the controller part 40 via a signal wire cable 27. The controller part 40 is connected to the drive unit 34 via a signal wire cable 41.

Operating conditions set by the user using the first operating part 21 are inputted into the controller part 40 via the signal wire cable 27. The controller part 40 controls the rotator part 30 via the signal wire cable 41 based on these operating conditions. More specifically, when the controller part 40 detects that the first start switch 24 is depressed by the user, the controller part 40 controls the drive unit 34 to start rotating the drive shaft 35 and the rotor 31 under the user's set operating conditions.

When the rotator part 30 is operating, that is, when the rotor 31 is rotating, the controller part 40 regularly acquires the operating status of the rotator part 30 via the signal wire cable 41, including the rotating speed of the rotor 31, sample temperature, and the like, and transmits this operating status to the first control panel 20 via the signal wire cable 27 to be displayed on the first display unit 22.

When the controller part 40 detects that the first stop switch 25 is depressed by the user, the controller part 40 controls the drive unit 34 to stop rotating the drive shaft 35.

The controller part 40 is also connected to a second control panel 50 via a power supply wire cable 42 and a communication wire cable 43. The second control panel 50 has the same functions as the first control panel 20. The second control panel 50 includes a second operating unit 51 and a second display unit 52. The second operating unit 51 has a second keypad 53, and a second start switch 54 and a second stop switch 55 for starting and stopping operations of the rotator part 30. The second keypad 53, second start switch 54, and second stop switch 55 have the same functions as the first keypad 23, first start switch 24, and first stop switch 25, respectively. The second display unit 52 also has the same functions as the first display unit 22. The second control panel 50 also includes a second emergency stop switch 56 having the same function as the first emergency stop switch 26.

The distance between the second control panel 50 and the casing 10 can be adjusted by changing the lengths of the power supply wire cable 42 and communication wire cable 43, allowing the second control panel 50 to be installed in a location or room separate from the casing 10 and first control panel 20.

Operating conditions set using the second operating unit 51 are inputted into the controller part 40 via the communication wire cable 43. The controller part 40 controls the rotator part 30 via the signal wire cable 41 according to these operating conditions. More specifically, when the controller part 40 detects that the second start switch 54 is depressed by the user, the controller part 40 controls the drive unit 34 to start rotating the drive shaft 35 and the rotor 31 under the user's set operating conditions.

While the rotator part 30 is operating, that is, when the rotor 31 is rotating, the controller part 40 regularly acquires the operating status of the rotator part 30 via the signal wire cable 41, including the rotating speed of the rotor 31, the sample temperature, and the like, and transmits this operating status to the second control panel 50 via the communication wire cable 43 to be displayed on the second display unit 52.

When the controller part 40 detects that the second stop switch 55 is depressed by the user, the controller part 40 controls the drive unit 34 to stop rotating the drive shaft 35.

Further, the operating conditions set using the first operating part 21 are not only displayed on the first display unit 22, but are simultaneously transferred via the signal wire cable 27, controller part 40, and communication wire cable 43 to be displayed on the second display unit 52. Similarly, the operating conditions set using the second operating unit 51 are displayed on the second display unit 52 and simultaneously transferred via the communication wire cable 43, controller part 40, and signal wire cable 27 to be displayed on the first display unit 22. Accordingly, after setting operating conditions using the first operating part 21 on the first control panel 20, the user can start the rotator part 30 by pressing the second start switch 54 on the second control panel 50. Likewise, the user can start the rotator part 30 by pressing the first start switch 24 after setting operating conditions using the second operating unit 51. After starting the rotator part 30 by pressing the first start switch 24, the user can stop the rotator part 30 by pressing the second stop switch 55 on the second control panel 50. Likewise, the user can stop the rotator part 30 by pressing the first stop switch 25 on the first control panel 20 after starting the rotator part 30 by pressing the second start switch 54. It is noted that when the desired operation period of time, which has been set at the control panel 20 or 50, has elapsed after the rotor 31 has started rotating, the controller part 40 controls the drive unit 34 to stop rotating the rotor 31.

After starting the rotator part 30 by pressing the first start switch 24, when abnormalities occur, the user can immediately stop the rotator part 30 by pressing the second emergency stop switch 56 on the second control panel 50. Likewise, after starting the rotator part 30 by pressing the second start switch 54, when abnormalities occur, the user can immediately stop the rotator part 30 by pressing the first emergency stop switch 26 on the first control panel 20.

When the controller part 40 detects that the first emergency stop switch 26 or the second emergency stop switch 56 is depressed by the user, the controller part 40 controls the drive unit 34 to stop rotating the drive shaft 35, brings the first operating part 21 and the second operating part 51 into a state inoperable by the user. As a result, the rotor 31 immediately stops rotating. The user becomes able to set operating conditions to neither the first operating part 21 nor the second operating part 51.

With this construction, the user can monitor the operating status of the rotator part 30 and can set and modify operating conditions using the second control panel 50 that is installed in a separate location from the main casing 10, without going directly to the first control panel 20. The user may also start and stop the operations of the rotator part 30 from the second control panel 50 located separate from the main casing 10, without going directly to the first control panel 20. Hence, operations of the centrifugal separator 1 can be performed highly efficiently. The user can check the operating conditions of the centrifugal separator 1 and set and modify operating conditions for the centrifugal separator 1 while performing other work in a location separate from the centrifugal separator 1.

Further, since the first emergency stop switch 26 is provided on the first control panel 20 and the second emergency stop switch 56 on the second control panel 50, the user can immediately stop operation of the centrifugal separator 1 when an abnormality occurs to the centrifugal separator 1. Especially, by using the second emergency stop switch 56 of the second control panel 50, the user can stop the centrifugal separator 1 from a safe location that is separate from the rotator part 30. Hence, this construction improves the safety of the centrifugal separator 1.

If the centrifugal separator 1 were provided with no second control panel 50, the user can confirm the operating status and set the operating conditions by using the first control panel 20 only. In such a case, if the centrifugal separator 1 is installed at a location separate from where the user usually stays, the user has to repeatedly access the centrifugal separator 1 in order to monitor the operating status and to set the operation conditions of the centrifugal separator 1. Especially, if the centrifugal separator 1 is installed in a test room that is isolated from a room where the user usually stays, the user has to enter the test room repeatedly in order to monitor the operating status of the centrifugal separator 1. The user has to remain in the test room when the user wants to monitor the operating status continuously. The user also has to enter the test room when he/she wants to set the operation conditions of the centrifugal separator 1.

Contrarily, according to the present embodiment, the centrifugal separator 1 is provided with the second control panel 50. Accordingly, the user can confirm the operating status and set the operating conditions by using his/her desired one of the first control panel 20 and the second control panel 50. If the main casing 10 is installed at a location separate from where the user usually stays, by locating the second control panel 50 at the location where the user usually stays, the user can monitor the operating status and set the operation conditions of the centrifugal separator 1 without accessing the main casing 10. Even if the main casing 10 is installed in the test room isolated from a room where the user usually stays, by locating the second control panel 50 in the room where he/she usually stays, the user can follow the operating status of the centrifugal separator 1 and set the operating conditions for the centrifugal separator 1 while staying in the room where he/she usually stays by manipulating the second control panel 50. The user can follow the operating status of the centrifugal separator 1 and set the operating conditions for the centrifugal separator 1 while performing other work.

<Modifications>

In the above description, when the controller part 40 detects that the emergency stop switch 26 or 56 is depressed by the user, the controller part 40 stops rotating the rotor 31 and brings the first control panel 20 and second control panel 50 into inoperable states. However, each emergency stop switch 26, 56 may be modified to shut off power upon being depressed by the user. For example, each switch 26, 56 may turn off a main power switch (not shown) provided in the main casing 10, to thereby stop supply of power to the main casing 10 from outside of the main casing 10. Or, each switch 26, 56 may activate a circuit breaker device (not shown), which is provided in a building or a room, in which the centrifugal separator 1 is mounted. By activating the circuit breaker device, it is possible to stop supply of power to the building or room from an outdoor electrical circuit, thereby stopping supply of power to the main casing 10.

The rotor 30 may be of any types other than the angle rotor.

Second Embodiment

Next, a centrifugal separator 101 according to a second embodiment of the present invention will be described with reference to FIG. 2.

Figure 2:
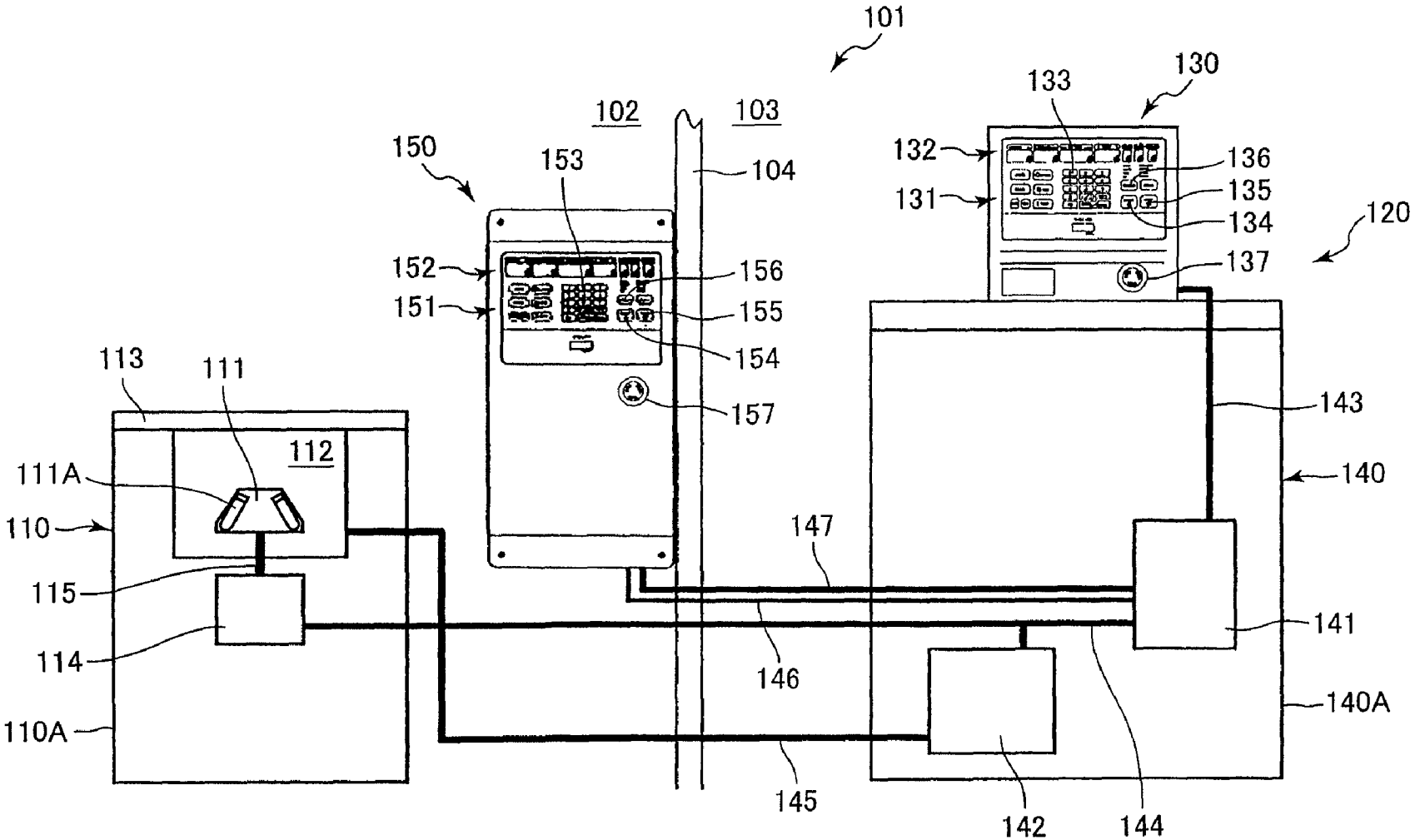
FIG. 2 is an explanatory diagram showing a centrifugal separator according to a second embodiment of the present invention.

As shown in FIG. 2, the centrifugal separator 101 includes a rotator part 110 for separating components in a liquid sample, a controller part 120 for controlling the rotator part 110, and a second control panel 150 disposed next to the rotator part 110. The rotator part 110 and second control panel 150 are installed in an isolated rotator room 102, while the controller part 120 is installed in a controller room 103 outside of the rotator room 102. A partitioning wall 104 forming part of the rotator room 102 is boundary between the rotator room 102 and controller room 103 and is preventing air from passing between the two rooms. The rotator room 102 is a clean room in this embodiment. It is noted that microparticles and mist will possibly be generated from a decompression pump 142 described later and fans (not shown), which are provided in the controller part 120. The microparticles and mist can be detrimental to liquid samples that undergo centrifugation in the rotator part 110. According to the present embodiment, therefore, the controller part 120 from which the microparticles and mist are generated is installed in the controller room 103, while the rotator part 110 that performs sample separation is installed in the rotator room 102.

The rotator part 110 has a rotor-part casing 110A forming the main body of the rotor part 110. A rotor chamber 112 is formed in the rotor-part casing 110A. A rotor 111 is disposed in the rotor chamber 112. The rotor 111 is for separating components in the liquid sample. The rotor 111 is an angle rotor and has the same configuration as the rotor 31 in the first embodiment. Several test tubes 111A are mounted in the rotor 111 in the same manner as the test tubes 31A in the first embodiment. A door 113 forming a portion of the rotator part 110 is provided on top of the rotor chamber 112 and seals the rotor chamber 112. A drive unit 114 for driving the rotor 111 to rotate is disposed in the rotor-part casing 110A. The driving force of the drive unit 114 is transferred to the rotor 111 via a drive shaft 115. The drive unit 114 rotates the rotor 111 via the drive shaft 115 in the same manner as the drive unit 34 in the first embodiment, thereby separating components in the liquid sample.

The controller part 120 includes a control unit 140. The control unit 140 has a control-unit casing 140A forming the main body of the control unit 140. In the control-unit casing 140A, the control unit 140 has a controller 141 for controlling the rotator part 110, and the decompression pump 142 for decompressing the rotor chamber 112. The controller part 120 also includes a first control panel 130 disposed on top of the control-unit casing 140A for enabling a user to set operating conditions of the rotator part 110.

The first control panel 130 is provided with: a first operating unit 131, and a first display unit 132. The first operating unit 131 is for setting operating conditions of the rotator part 110. Representative examples of the operating conditions include: a desired rotating speed, at which the rotor 111 is desired to be rotated; and a desired operation period of time (a period of time, during which the rotor 111 is desired to be rotated). The first display unit 132 is for displaying the operating conditions and the operating status of the rotator part 110.

The first operating unit 131 includes: a first keypad 133 for inputting operating conditions, such as the desired rotating speed of the rotor 111, and the desired operation period of time of the rotor 111; a first start switch 134 and a first stop switch 135 for starting and stopping operations of the rotator part 110; and a first decompression switch 136.

After setting operating conditions using the first operating unit 131, the user may start up the rotator part 110 by pressing the first start switch 134 or stop operations of the rotator part 110 by pressing the first stop switch 135. The decompression pump 142 is activated by pressing the first decompression switch 136. The first display unit 132 can display the operating conditions set using the first operating unit 131, as well as the operating status of the rotator part 110 while the rotor 111 is rotating. The operating status of the rotator part 110 includes: a rotating speed, at which the rotor 111 is presently rotating; a sample temperature; a period of time elapsed after the rotor 111 has started rotating; and alarms. The first control panel 130 is also provided with a first emergency stop switch 137. By pressing the first emergency stop switch 137, the user can immediately stop the operation of the rotator part 110, the first operating part 131, and a second operating part 151 (described later) in the second control panel 150.

The first control panel 130 is connected to the controller 141 via a signal wire cable 143. The controller 141 is connected to the drive unit 114 and the decompression pump 142 via a signal wire cable 144. The decompression pump 142 is connected to the rotor chamber 112 via a decompression hose 145.

Operating conditions set using the first operating unit 131 are inputted into the controller 141 via the signal wire cable 143. The controller 141 controls the drive unit 114 and the decompression pump 142 via the signal wire cable 144 based on these operating conditions. The decompression pump 142 draws air out of the rotor chamber 112 via the decompression hose 145 to decompress the rotor chamber 112. While the rotator part 110 is operating, the controller 141 regularly acquires the operating status of the rotator part 110 via the signal wire cable 144, including the rotating speed of the rotor 111 and the sample temperature, and transmits this operating status to the first control panel 130 via the signal wire cable 143 to be displayed on the first display unit 132.

The controller 141 is connected to the second control panel 150 by a power source wire cable 146 and a communication wire cable 147. The second control panel 150 installed in the rotator room 102 has the same functions as the first control panel 130. The second control panel 150 is provided with a second operating unit 151 and a second display unit 152. The second operating unit 151 includes a second keypad 153, a second start switch 154 and a second stop switch 155 for starting and stopping operations of the rotator part 110, and a second decompression switch 156. The second keypad 153, second start switch 154, second stop switch 155, and second decompression switch 156 have the same functions as the first keypad 133, first start switch 134, first stop switch 135, and first decompression switch 136, respectively. The second display unit 152 also has the same function as the first display unit 132. The second control panel 150 also includes a second emergency stop switch 157 that has the same function as the first emergency stop switch 137.

The operating conditions set using the second operating unit 151 are inputted into the controller 141 via the communication wire cable 147. The controller 141 controls the rotator part 110 and the decompression pump 142 via the signal wire cable 144 based on these operating conditions. While the rotator part 110 is operating, the controller 141 regularly acquires the operating status of the rotator part 110 via the signal wire cable 144, including the rotating speed of the rotor 111, the sample temperature, and the like, and transmits this operating status to the second control panel 150 via the communication wire cable 147 to be displayed on the second display unit 152.

The operating conditions set using the first operating unit 131 is displayed on the first display unit 132 and simultaneously transferred via the signal wire cable 143, controller 141, and communication wire cable 147 to be displayed on the second display unit 152. Similarly, the operating conditions set using the second operating unit 151 are displayed on the second display unit 152 and simultaneously transferred via the communication wire cable 147, controller 141, and signal wire cable 143 to be displayed on the first display unit 132. Accordingly, after setting operating conditions with the first operating unit 131 of the first control panel 130, the user can press the second start switch 154 to start the rotator part 110, and conversely can press the first start switch 134 to start the rotator part 110 after setting operating conditions using the second operating unit 151.

When the controller 141 detects the first emergency stop switch 137 or the second emergency stop switch 157 is depressed by the user, the controller 141 controls the drive unit 114 to stop rotating the rotor 111, brings the first operating part 131 and the second operating part 151 into a state inoperable by the user. As a result, the rotor 111 immediately stops rotating. The user becomes able to set operating conditions to neither the first operating part 131 nor the second operating part 151.

The signal wire cable 144, decompression hose 145, power source wire cable 146, and communication wire cable 147 pass through the partitioning wall 104 while maintaining the airtight integrity of the partitioning wall 104. One method for achieving this airtightness employs a plate member that has hermetic seal connectors and pipe connectors and that is mounted in the wall by bolts or other fixing mechanism and sealed with a sealing member such as rubber packing.

By providing the first control panel 130 in the controller room 103 in which the controller part 120 is installed and the second control panel 150 in the rotator room 102 in which the rotator part 110 is installed, the user can set and modify operating conditions and monitor the operating status from either room.

Further, the user can start or stop operations of the rotator part 110 from the second control panel 150 in the rotator room 102 without going to the first control panel 130. Accordingly, it is possible to reduce the frequency at which the user walks back and forth between the controller room 103 and rotator room 102, thereby improving work efficiency for performing centrifugation.

Further, by providing the first emergency stop switch 137 on the first control panel 130 and the second emergency stop switch 157 on the second control panel 150, the user can immediately stop rotating the rotor 111 when an abnormality occurs in the rotator part 110. Accordingly, safety of the centrifugal separator 101 can be improved.

<Modifications>

In the above description, when the controller part 140 detects that the emergency stop switch 137 or 157 is depressed by the user, the controller part 140 stops rotation of the rotor 111 and brings the first control panel 130 and second control panel 150 into inoperable states. However, each emergency stop switch 137, 157 may be modified to shut off power upon being depressed by the user. For example, each switch 137, 157 may turn off a main power switch (not shown) mounted in the control-unit casing 140A to stop supplying power to the control-unit casing 140A. Or, each switch 137, 157 may turn off the main power switch (not shown) mounted in the control-unit casing 140A and another main power switch (not shown) mounted in the rotor-part casing 110A to stop supplying power to the control-unit casing 140A and the rotor-part casing 110A. Or, each switch 137, 157 may activate a circuit breaker device (not shown), which is provided in a building in which the rooms 102 and 103 are located. By activating the circuit breaker device, it is possible to stop supply of power to the rooms 102 and 103 from outdoor electrical circuits, thereby stopping supply of power to the control-unit casing 140A and the rotor-part casing 110A.

The rotor 111 may be of types other than the angle rotor.

Third Embodiment

A centrifugal separator according to a third embodiment of the present invention will be described while referring to FIGS. 3(*a*) through 7.

Figure 3A:
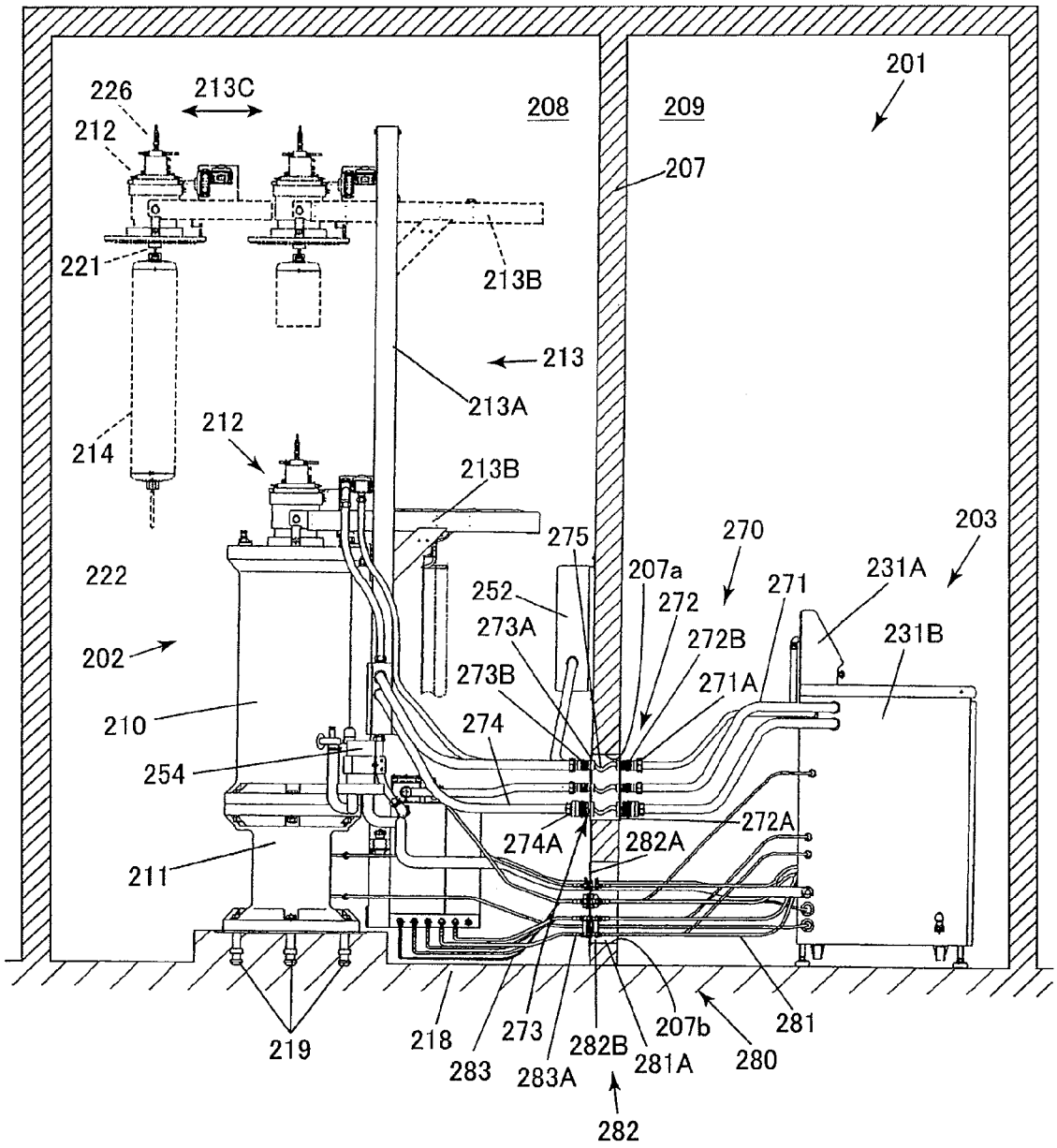
FIG. 3(*a*) is a side view showing a centrifugal separator according to a third embodiment of the present invention.
Figure 3B:
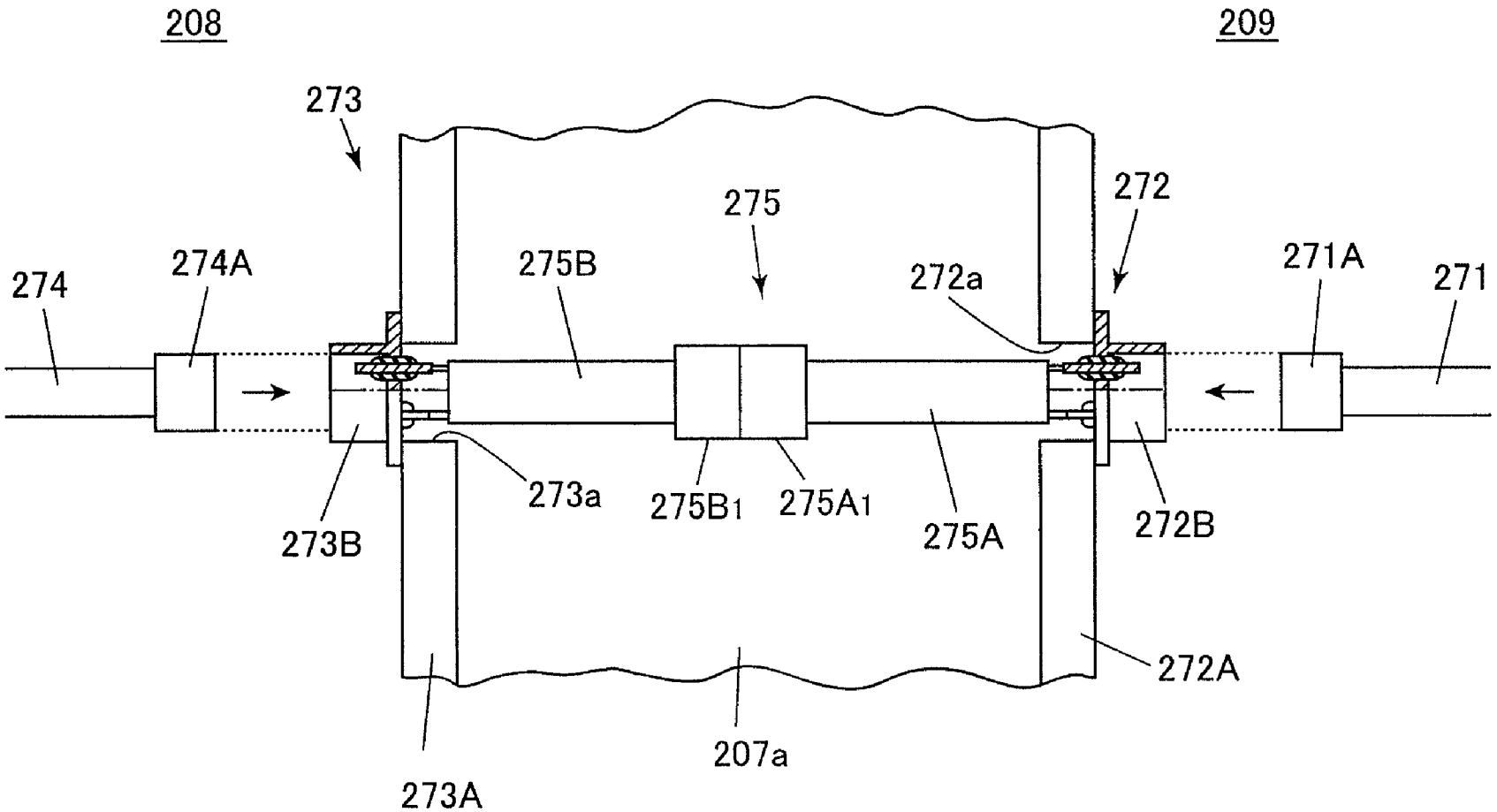
Figure 3C:
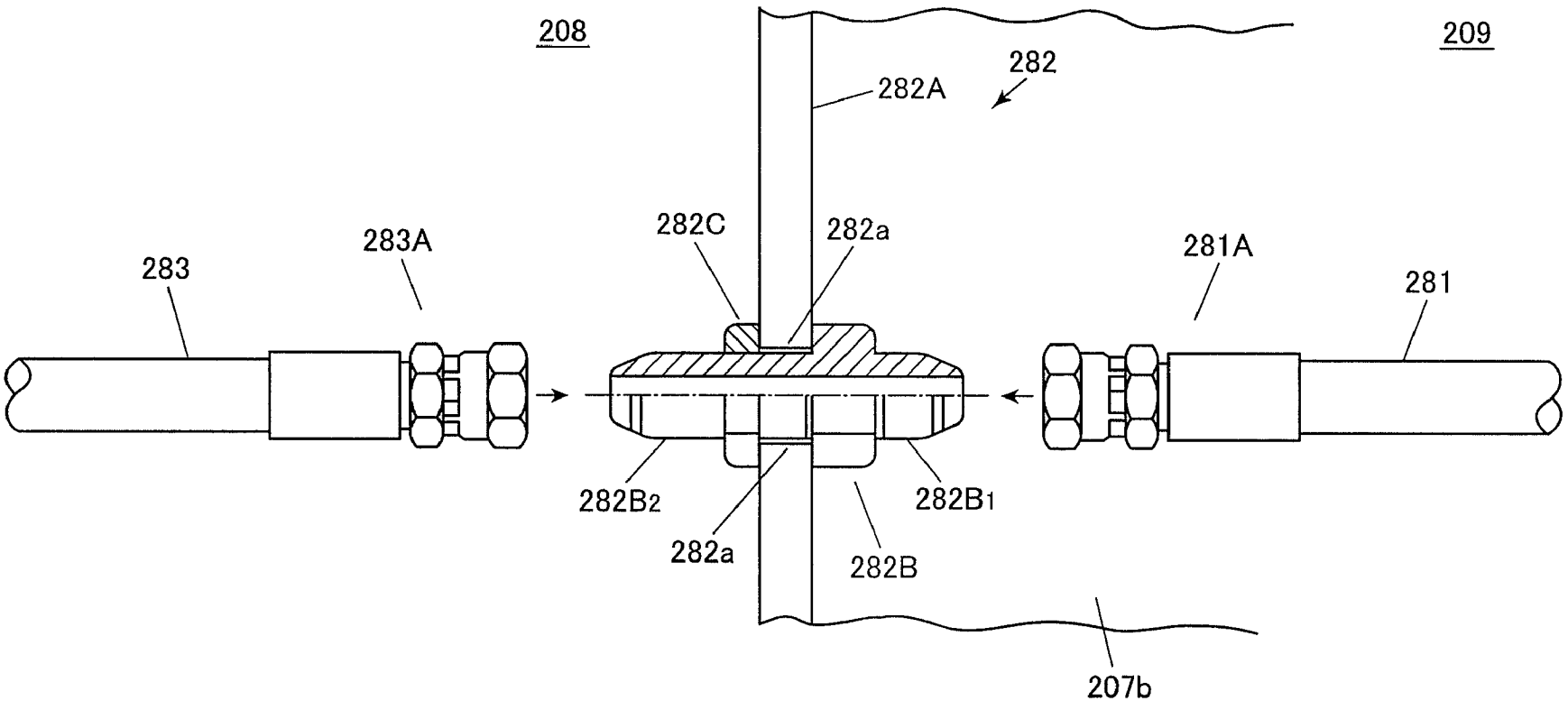

As shown in FIGS. 3(*a*) and 4, a centrifugal separator 201 of the present embodiment includes: a rotator part 202 for separating components in a liquid sample; a controller part 203 for controlling the rotator part 202 by setting operating conditions for the rotator part 202; and an electric wiring part 270 and a piping part 280, each for connecting the rotator part 202 and controller part 203.

The centrifugal separator 201 is of a type that performs centrifugation on a liquid sample that is continuously supplied into the rotator part 202, thereby separating components in the liquid sample. The rotator part 202 is disposed in an isolated rotator room 208, while the controller part 203 is installed in a controller room 209 separate from the rotator room 208. A partitioning wall 207 separates the rotator room 208 from the controller room 209 and prevents the passage of air from one room to the other. While the passage of air is prevented between the rotator room 208 and controller room 209, an electric-wiring through-hole 207*a* and a piping through-hole 207*b* are formed through the partitioning wall 207 allowing the electric wiring part 270 and the piping part 280 to pass through the partitioning wall 207 to connect the rotator part 202 to the controller part 203. The rotator room 208 is a clean room in this embodiment.

The rotator part 202 includes: a support part 211, a chamber part 210, a drive part 212, and a lift mechanism 213.

The support part 211 is fixed to a floor 218 by first bolts 219. The chamber part 210 is fixed on the top of the support part 211. A cylindrical rotor 214 (see FIG. 6) is mounted in the chamber part 210. The drive part 212 is disposed on top of the chamber part 210.

As shown in FIG. 3(*a*), the lift mechanism 213 is disposed on the right side of the chamber part 210 and is configured of a vertical guide member 213A extending vertically and a horizontal guide member 213B extending horizontally. A guide groove (not shown) is formed vertically in the vertical guide member 213A. The horizontal guide member 213B is slidably connected to the vertical guide member 213A and is capable of rising and falling along the guide groove formed therein.

The drive part 212 is connected to a tip end of the horizontal guide member 213B via an upper plate 217 (FIG. 6) of the chamber part 202 described later. The horizontal guide member 213B has a movement mechanism (not shown) for moving the drive part 212 in a horizontal direction indicated by an arrow 213C.

As indicated by broken lines in FIG. 3(*a*), the horizontal guide member 213B is raised, and the movement mechanism moves to the left the drive unit 212, from which the rotor 214 is suspended. A lower rotating shaft 222 described later (FIG. 6) extends downwardly from the rotor 214.

Figure 4:
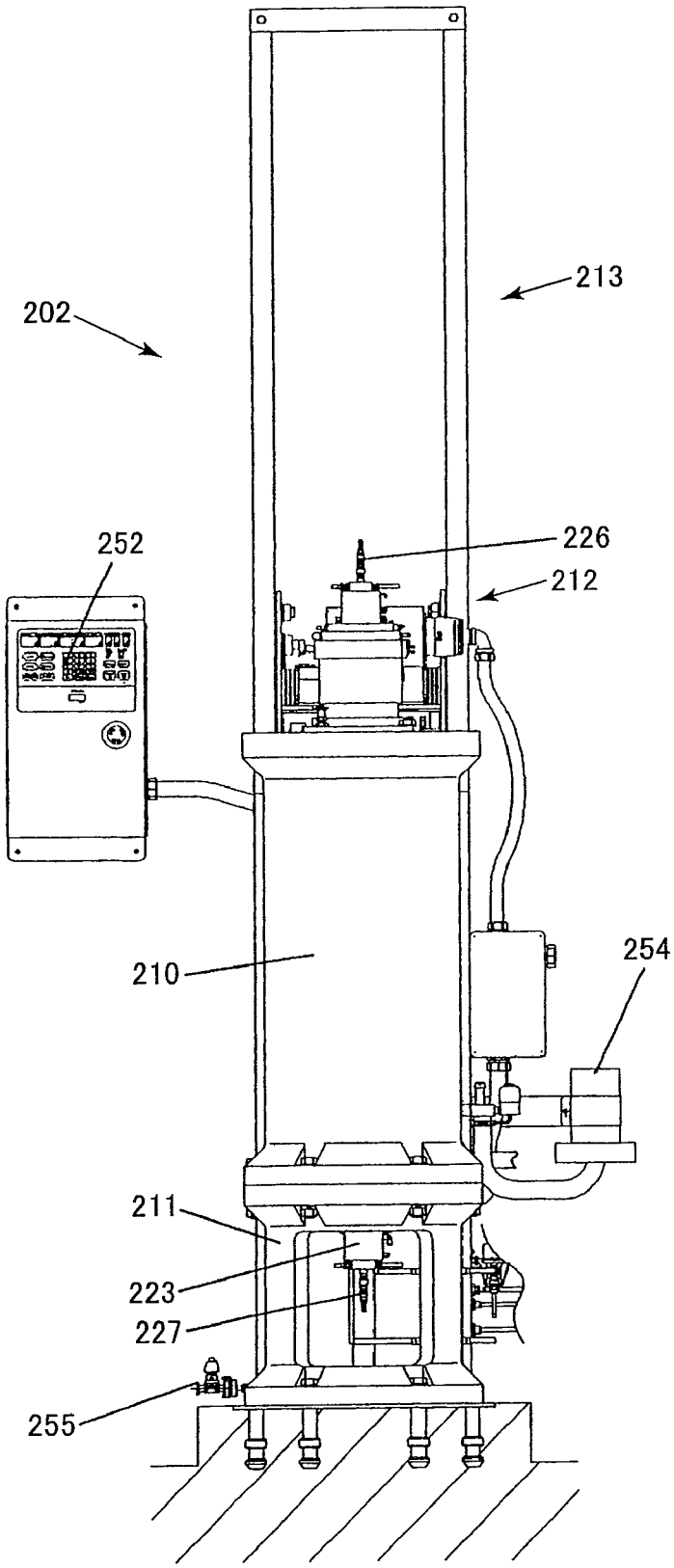
FIG. 4 is a front view of a rotator part in the centrifugal separator in FIG. 3(*a*) and viewed from a left side in FIG. 3(*a*)

As shown in FIG. 4, the lift mechanism 213 is provided with a cooling water outlet 255 for discharging cooling water. The cooling water is used to cool mechanical seals 224 and 225 (FIG. 6) described later.

A filter 254 for trapping components of the liquid sample is disposed on the bottom right side of the chamber part 210 in FIG. 4. The filter 254 is located between the chamber part 210 and a decompression pump 235 (FIG. 7) described later. The filter 254 is formed of a mesh with openings smaller than the microcomponents in the liquid sample. For example, the openings of the mesh may be 0.1-0.2 μm for trapping viruses or microbes.

Figure 5:
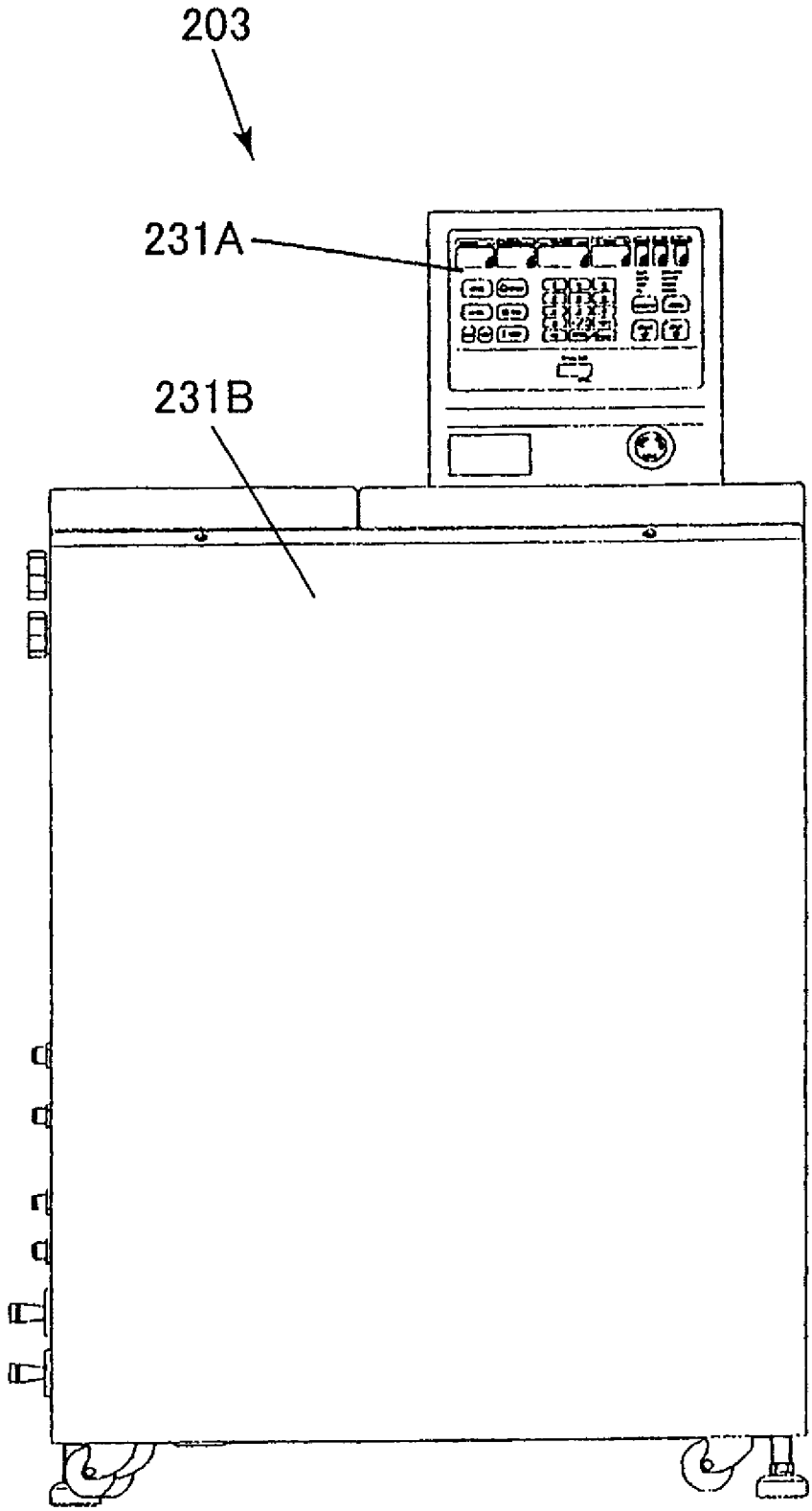
FIG. 5 is a front view of a controller part in the centrifugal separator in FIG. 3(*a*) and viewed from a right side in FIG. 3(*a*)

As shown in FIG. 5, the controller part 203 includes a first control panel 231A and a supply unit 231B. The first control panel 231A has the same functions as the first control panel 20 in the first embodiment and as the first control panel 130 in the second embodiment. The supply unit 231B accommodates therein: various supply mechanisms for supplying cooling water, a refrigerant, and the like described later to the rotator part 202; and a control unit (not shown) for controlling each of the supply mechanisms and for controlling the rotator part 202 in the same manner as the controller 141 in the second embodiment.

As shown in FIG. 4, the rotator part 202 is further provided with a second control panel 252. The second control panel 252 is therefore disposed in the isolated rotator room 208. The second control panel 252 has the same functions as the control panel 231A and is for controlling and monitoring the rotator part 202. The second control panel 252 has the same functions as the second control panels 50 and 150 in the first and second embodiments.

The electric wiring part 270 is for electrically connecting the controller part 203 with the rotator part 202. By using the electric wiring part 270, the controller part 203 can control the operation of the rotator part 202.

The electric wiring part 270 includes: first electric wire cables 271 extending from the supply unit 231B; a first sealing member 272; connection electric wire cables 275; a second sealing member 273; and second electric wire cables 274 extending from the rotator part 202. The total number of the first electric wire cables 271 is equal to the total number of the second electric wire cables 274 and also to the total number of the connection electric wire cables 275.

The first electric wire cables 271 include: power cables connected to the supply unit 231B; and signal cables connected to the supply unit 231B.

The second electric wire cables 274 include other power cables and other signal cables. The power cables in the second electric wire cables 274 are connected to: the drive part 212; the second control panel 252; emergency stop valves 253*a*-253*e* (see FIG. 7) described later; other various parts in the rotator part 202; and various sensors (not shown). The signal cables in the second electric wire cables 274 are connected to: the drive part 212, the second control panel 252; the emergency stop valves 253*a*-253*e*; other various parts in the rotator part 202; and various sensors (not shown).

The first sealing member 272 and the second sealing member 273 are for electrically connecting the first electric wire cables 271 with the second electric wire cables 274 via the connection electric wire cables 275 while maintaining the airtight quality of the rotator room 208.

The first sealing member 272 includes: a first plate member 272A, and a plurality of first hermetic seal connectors 272B. The first plate member 272A is mounted on the opening in the controller room 209 side of the electric-wiring through-hole 207*a* with rubber packing or the like, thereby preventing the passage of air between the controller room 209 and the space within the through-hole 207*a*. The plurality of first hermetic seal connectors 272B are mounted on the first plate member 272A in one-to-one correspondence with the plurality of first electric wire cables 271.

The second sealing member 273 includes a second plate member 273A, and a plurality of second hermetic seal connectors 273B. The second plate member 273A is mounted on the opening in the rotator room 208 side of the electric-wiring through-hole 207*a* using rubber packing or the like, thereby preventing the passage of air between the rotator room 208 and the space within the through-hole 207*a*. The plurality of second hermetic seal connectors 273B are mounted on the second plate member 273A in one-to-one correspondence with the plurality of second electric wire cables 274.

The plurality of connection electric wire cables 275 are provided within the through-hole 207*a* to electrically connect the first hermetic seal connectors 272B with the second hermetic seal connectors 273B, respectively.

It is noted that although not shown in FIG. 3(*a*), a plurality of first through-holes 272*a* are formed through the first plate member 272A in one-to-one correspondence with the plurality of first electric wire cables 271 and that a plurality of second through-holes 273*a* are formed through the second plate member 273A in one-to-one correspondence with the plurality of second electric wire cables 274. One of the first through-holes 272*a* and one of the second through-holes 273*a* are shown in FIG. 3(*b*).

Each first electric wire cable 271 is electrically connected with a corresponding second electric wire cable 274 via a corresponding first hermetic seal connector 272B, a corresponding connection electric wire cable 275, and a corresponding second hermetic seal connector 273B in a manner shown in FIG. 3(*b*).

As shown in FIG. 3(*b*), each first hermetic seal connector 272B is mounted on the first plate member 272A on its controller room 209 side. The first hermetic seal connector 272B is located on a corresponding first through-hole 272*a*. The first hermetic seal connector 272B is mounted on the first plate member 272A, with an O-ring or the like (not shown) being inserted between the first hermetic seal connector 272B and the first plate member 272A. Accordingly, it is possible to prevent passage of air between the controller room 209 and the space within the through-hole 207*a*.

Similarly, each second hermetic seal connector 273B is mounted on the second plate member 273A on its rotator room 208 side. The second hermetic seal connector 273B is located on a corresponding second through-hole 273*a*. The second hermetic seal connector 273B is mounted on the second plate member 273A, with an O-ring or the like (not shown) being inserted between the second hermetic seal connector 273B and the second plate member 273A. Accordingly, it is possible to prevent passage of air between the rotator room 208 and the space within the through-hole 207*a*.

It is noted that FIG. 3(*b*) illustrates a section in an upper half of the first hermetic seal connector 272B and an upper half of the second hermetic seal connector 273B. As shown in FIG. 3(*b*), each hermetic seal connector 272B, 273B has a main plate, through which a plurality of pins are inserted via a hermetic glass seal material. Thus, each hermetic seal connector 272B, 273B serves as a male or plug connector. For example, a connector in "HMS02 series" (model name), such as a connector "HMS02-24-28P11" (model name) or a "HMS02-18-11" (model name), manufactured by Daitron Technology Co., Ltd. can be employed as each hermetic seal connector 272B, 273B.

A first female or socket connector 271A is attached to one end of each first electric wire cable 271. The first female connector 271A of each first electric wire cable 271 is electrically connected to the corresponding first hermetic seal connector 272B.

Similarly, a second female or socket connector 274A is attached to one end of each second electric wire cable 274. The second female connector 274A of each second electric wire cable 274 is electrically connected to the corresponding second hermetic seal connector 273B.

Each connection electric wire cable 275 includes: two electric wire cables 275A and 275B. The electric wire cable 275A is electrically connected to the first hermetic seal connector 272B at one end. More specifically, one ends of wires in the electric wire cable 275A are connected with solder to the pins in the first hermetic seal connector 272B. Similarly, the electric wire cable 275B is electrically connected to the second hermetic seal connector 273B at one end. More specifically, one ends of wires in the electric wire cable 275B are connected with solder to the pins in the second hermetic seal connector 273B. The electric wire cable 275A has a connector 275A1 at the other end, and the electric wire cable 275B has a connector 275B1 at the other end. Each first hermetic seal connector 272B is electrically connected with a corresponding second hermetic seal connector 273B when the connector 275A1 and the connector 275B1 are electrically connected to each other. In this way, each first electric wire cable 271 is electrically connected to a corresponding second electric wire cable 274.

The piping part 280 is for fluidly communicating the controller part 203 with the rotator part 202. By using the piping part 280, the controller part 203 can control the operation of the rotator part 202.

The piping part 280 includes: first pipes 281 extending from the supply unit 231B; a third sealing member 282; and second pipes 283 extending from the rotator part 202. The total number of the first pipes 281 is equal to the total number of the second pipes 283.

The third sealing member 282 is for fluidly communicating the first pipes 281 with the second pipes 283 while maintaining the airtight quality of the rotator room 208.

As shown in FIG. 3(*a*), the third sealing member 282 includes: a third plate member 282A, and a plurality of piping connection adaptors 282B. The third plate member 282A is mounted on the opening in the rotator room 208 side of the piping through-hole 207*b* using rubber packing or the like, thereby preventing the passage of air between the rotator room 208 and the control room 209. The plurality of piping connection adaptors 282B are provided on the third plate member 282A in one-to-one correspondence with the plurality of first pipes 281 and in one-to-one correspondence with the plurality of second pipes 283.

It is noted that although not shown in FIG. 3(*a*), a plurality of third through-holes 282*a* are formed through the third plate member 282A in one-to-one correspondence with the plurality of first pipes 281 and in one-to-one correspondence with the plurality of second pipes 283. One of the third through-holes 282*a* is shown in FIG. 3(*c*).

Each first pipe 281 is fluidly communicated with a corresponding second pipe 283 via a corresponding piping connection adaptor 282B as shown in FIG. 3(*c*).

As shown in FIG. 3(*c*), each piping connection adaptor 282B is inserted through the third through-hole 282*a* from the controller room 209 side to the rotator room 208 side. An O-ring or the like (not shown) is inserted between a flange portion of the piping connection adaptor 282B and the controller room 209 side surface of the third plate member 282A. It is therefore possible to prevent passage of air between the controller room 209 and the rotator room 208.

A screw nut 282C is mounted on the piping connection adaptor 282B at the rotator room 208 side to fixedly secure the piping connection adaptor 282B to the third plate member 282A. Another O-ring or the like (not shown) is inserted between the screw nut 282C and the rotator room 208 side surface of the third plate member 282A, thereby preventing the passage of air between the controller room 209 and the rotator room 208. The piping connection adaptor 282B has a fluid path extending along its elongated axis. The piping connection adaptor 282B has threaded outer surfaces 282B1 and 282B2 at its both ends.

It is noted that FIG. 3(*c*) illustrates a section in an upper half of the piping connection adaptor 282B and an upper half of the screw nut 282C.

A first piping connector 281A is attached to one end of each first pipe 281. The first piping connector 281A of each first pipe 281 is in threaded connection with the threaded surface 282B1 of a corresponding piping connection adaptor 282B. Similarly, a second piping connector 283A is attached to one end of each second pipe 283. The second piping connector 283A of each second pipe 283 is in threaded connection with the threaded surface 282B2 of a corresponding piping connection adaptor 282B. In this way, each first pipe 281 is fluidly communicated with a corresponding second pipe 283 via the corresponding piping connection adaptor 282B.

For example, a piping connection adaptor "020 Panel Touch" (trade name) with a model name "020-04-04" manufactured by Nitta Moore Company can be employed as the piping connection adaptor 282B, a hose "100R-04" (model name) manufactured also by Nitta Moore Company can be employed as each pipe 281, 283, and a piping connector "Swage connector" (trade name) with model name "SE-PF-04" manufactured also by Nitta Moore Company can be employed as each of the first and second piping connectors 281A, 283A.

A plurality of pairs of first and second pipes 281 and 283 are fluidly communicated with each other in the above-described manner, to thereby establish a second cooling water channel 241-2, a fifth cooling water channel 242-1, an eighth cooling water channel 242-4, a first decompression pipe 243-1, a first refrigerant pipe 244-1, a second refrigerant pipe 244-2, a first hydraulic channel 247-1, and a second hydraulic channels 247-2 (FIG. 7) described later.

Next, the construction of the support part 211, chamber part 210, and drive part 212 will be described with reference to FIG. 6.

Figure 6:
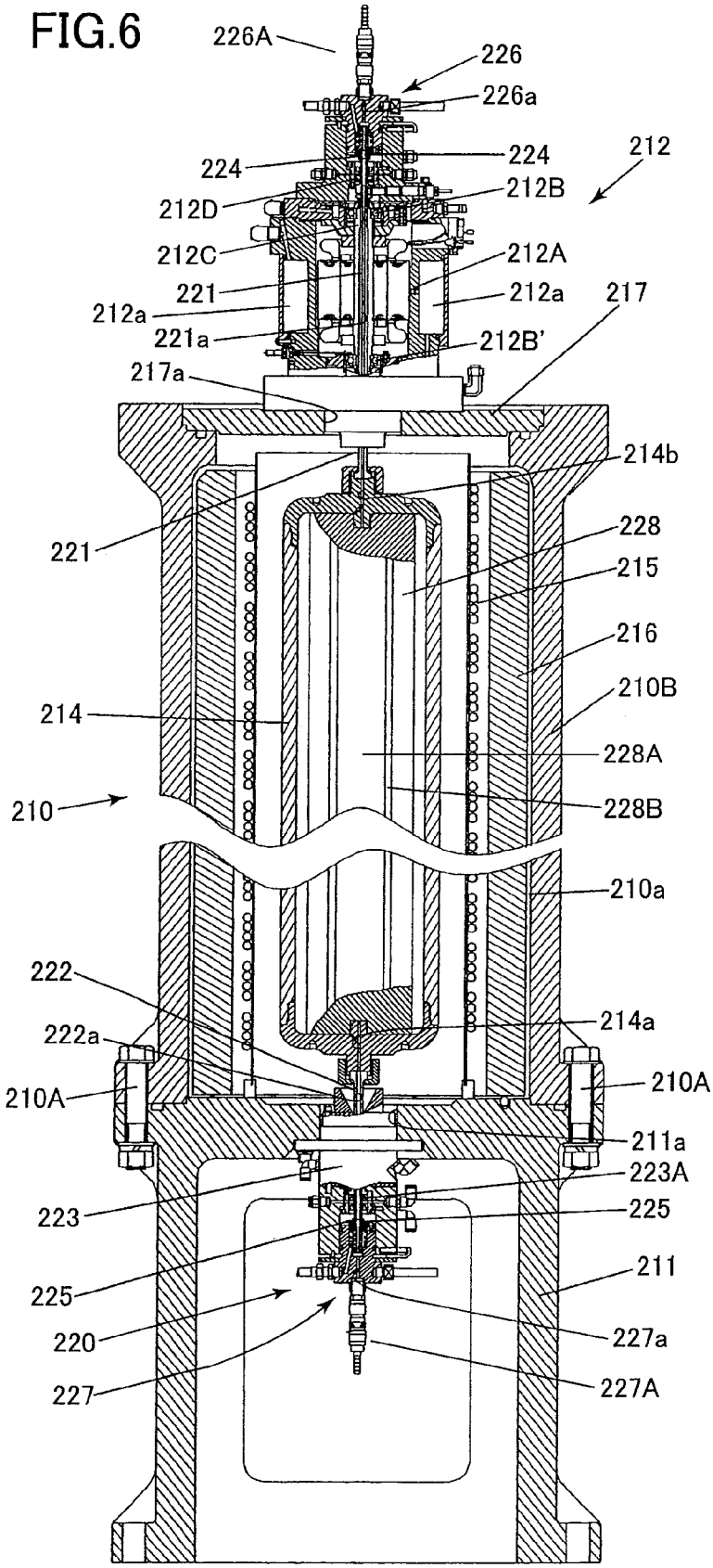
FIG. 6 is a cross-sectional view of a support part, chamber part, and drive unit of the rotator part in FIG. 4.

FIG. 6 is a cross-sectional view of the support part 211, chamber part 210, and drive part 212.

The support part 211 includes a supporting unit 220. The supporting unit 220 includes: a lower bearing part 223 for rotatably supporting the lower rotating shaft 222 of the cylindrical rotor 214 that extends from the chamber part 210; and a first connector portion 227 for injecting a liquid sample into the cylindrical rotor 214 through the lower rotating shaft 222 and for recovering the liquid sample from the rotor 214 also through the lower rotating shaft 222.

More specifically, a support through-hole 211*a* is formed through the top center of the support part 211. The supporting unit 220 is disposed so as to block up the support through-hole 211*a*. The supporting unit 220 is provided with the lower bearing part 223 having a bearing (not shown) for rotatably supporting the lower rotating shaft 222, which extends from the rotor 214 into the supporting unit 220.

The first connector portion 227 is provided on the bottom of the lower bearing part 223. A first connector 227A extends downwardly from a bottom end of the first connector portion 227. The first connector 227A has a fluid channel (not shown) for injecting the liquid sample into the rotor 214 and for recovering the liquid sample from the rotor 214. A first connecting channel 227*a* is formed in the first connector portion 227. The first connecting channel 227*a* is in fluid communication with the fluid channel in the first connector 227A and is for guiding the liquid sample between the rotor 214 and the first connector 227A.

The mechanical seal 225 is provided at the point of connection between the lower rotating shaft 222 and the first connector portion 227.

A lip seal 223A is provided on the lower bearing part 223 for maintaining the air tightness of a chamber 210*a* (described later) in the chamber part 210 when the chamber part 210 is decompressed for centrifugation.

Next, the cylindrical chamber part 210 will be described.

The chamber part 210 includes a cylindrical wall 210B defining a chamber 210*a* therein. The wall 210B is fixed to the support part 211 by second bolts 210A. The support part 211 forms a hermetic seal on the bottom side of the chamber 210*a*.

The cylindrical rotor 214 is mounted in the chamber part 210. The cylindrical rotor 214 is for receiving therein the liquid sample. The lower rotating shaft 222 and an upper rotating shaft 221 are fixed to the rotor 214. The lower rotating shaft 222 extends downwardly from the rotor 214. The upper rotating shaft 221 extends upwardly from the rotor 214. The upper and lower rotating shafts 221 and 222 extend along a rotational axis of the rotor 214. When the rotor 214 rotates around the rotational axis, components in the liquid sample are separated. The rotor 214 is mounted inside the chamber part 210, with the lower rotating shaft 222 extending out of the chamber part 210 into the supporting unit 220 and the upper rotating shaft 221 extending out of the chamber part 210 into the drive part 212.

More specifically, the rotor 214 is disposed in the center of the chamber 210*a* with its axis oriented vertically. A core 228 is fixed inside the rotor 214. The core 228 includes a central shaft 228A and a plurality of partitioning plates 228B. The central shaft 228A extends along the axis of the rotor 214. The partitioning plates 228B are disposed at regular intervals on the peripheral surface of the central shaft 228A and extend along the axis of the central shaft 228A, while protruding radially outward. Hence, the core 228 divides the interior of the rotor 214 into a plurality of compartments. The compartments are filled with liquid samples.

A first rotor channel 214*a* is formed in the bottom center of the rotor 214 for injecting or discharging a liquid sample therethrough. The lower rotating shaft 222 is fixed to the bottom end of the rotor 214 and extends downwardly to the lower bearing part 223. A lower channel 222*a* is formed in the center of the lower rotating shaft 222 along the axis thereof.

The first rotor channel 214*a* and the lower channel 222*a* are in fluid communication with each other. The lower channel 222*a* and the first connecting channel 227*a* are in fluid communication with each other.

A second rotor channel 214*b* is formed in the top center of the rotor 214 for discharging the liquid sample therethrough. An upper rotating shaft 221 is fixed on the top side of the rotor 214 and extends upwardly to the drive part 212. An upper channel 221*a* is formed in the center of the upper rotating shaft 221 along the axis thereof and is in fluid communication with the second rotor channel 214*b*.

A cooling coil 215 for supplying a refrigerant to cool the rotor 214 is provided on the outer side of the rotor 214 along the axis thereof. A protective wall 216 is provided on the outside of the cooling coil 215 along the axis thereof.

The circular upper plate 217 is disposed on the top of the chamber 210*a* and forms a hermetic seal on this top side. Accordingly, the support part 211 and the upper plate 217 hermetically seal the chamber 210*a*. A decompression pipe connection (not shown) is provided on the chamber part 210 in order to decompress the chamber 210*a* when performing centrifugation.

The drive part 212 is disposed on top of the upper plate 217. The drive part 212 is for receiving therein the upper rotating shaft 221 that extends from the rotor 214 and for driving the rotor 214 to rotate.

The bottom of the drive part 212 fits into an upper plate through-hole 217*a* formed through the center of the upper plate 217 and blocks the passage of air through the upper plate through-hole 217*a*. The drive part 212 has an upper bearing part 212A, which serves as a housing of the drive part 212. A motor is fixedly mounted in the upper bearing part 212A. The motor has a drive shaft 212C. A top bearing 212B and a bottom bearing 212B' are provided in the upper bearing part 212A for rotatably supporting the drive shaft 212C. The drive shaft 212C is rotated by the driving force generated by the motor. The upper rotating shaft 221 extends upwardly from the rotor 214 and extends inside the drive shaft 212C coaxially with the drive shaft 212C. The upper rotating shaft 221 is fixedly secured in the drive shaft 212C, and rotates integrally with the drive shaft 212C when the drive shaft 212C rotates.

A second connector portion 226 is provided on top of the upper bearing part 212A. A second connecting channel 226*a* is formed in the second connector portion 226 in fluid communication with the upper channel 221*a*, and is for guiding a supernatant liquid, which results when components in the sample liquid are separated, from the rotor 214 and the upper rotational shaft 221. A second connector 226A extends upwardly from a top of the second connector portion 226. The second connector 226A has a fluid channel (not shown) therein, which is in fluid communication with the second connecting channel 226*a* and which is for discharging the supernatant liquid.

The mechanical seal 224 is provided at the point of connection between the second connector portion 226 and the upper rotating shaft 221.

A lip seal 212D is provided in the upper bearing part 212A for maintaining the airtight integrity of the chamber 210*a* when the chamber 210*a* is decompressed for centrifugation.

An annular space 212*a* is formed in the upper bearing part 212A. Cooling water flows through the annular space 212*a* to cool the upper bearing part 212A.

Hence, a channel for the liquid sample is formed from the first connector 227A to the second connector 226A via the first connecting channel 227*a*, lower channel 222*a*, first rotor channel 214*a*, rotor 214, second rotor channel 214*b*, upper channel 221*a*, and second connecting channel 226*a*.

The rotor 214, upper rotating shaft 221, and lower rotating shaft 222 integrally rotate by the driving force of the drive part 212, which operates according to conditions set by the first control panel 231A or the second control panel 252. The liquid sample is injected through the first connector 227A and introduced into the rotor 214 via the first connecting channel 227*a* and the lower channel 222*a*. The liquid sample is subjected to a centrifugal force in the rotor 214 that separates components in the liquid sample. While the rotor 214 is rotating to subject the liquid sample to the centrifugal force, a supernatant liquid is produced and discharged via the second rotor channel 214*b*, upper channel 221*a*, second connecting channel 226*a*, and the second connector 226A. The rotor 214 is then halted, and the liquid sample, whose components have been separated from one another, is collected through the first connector 227A. It is noted that the sample liquid can be injected into the rotor 214 through the first connector 227A even while the rotor 214 is rotating.

Figure 7:
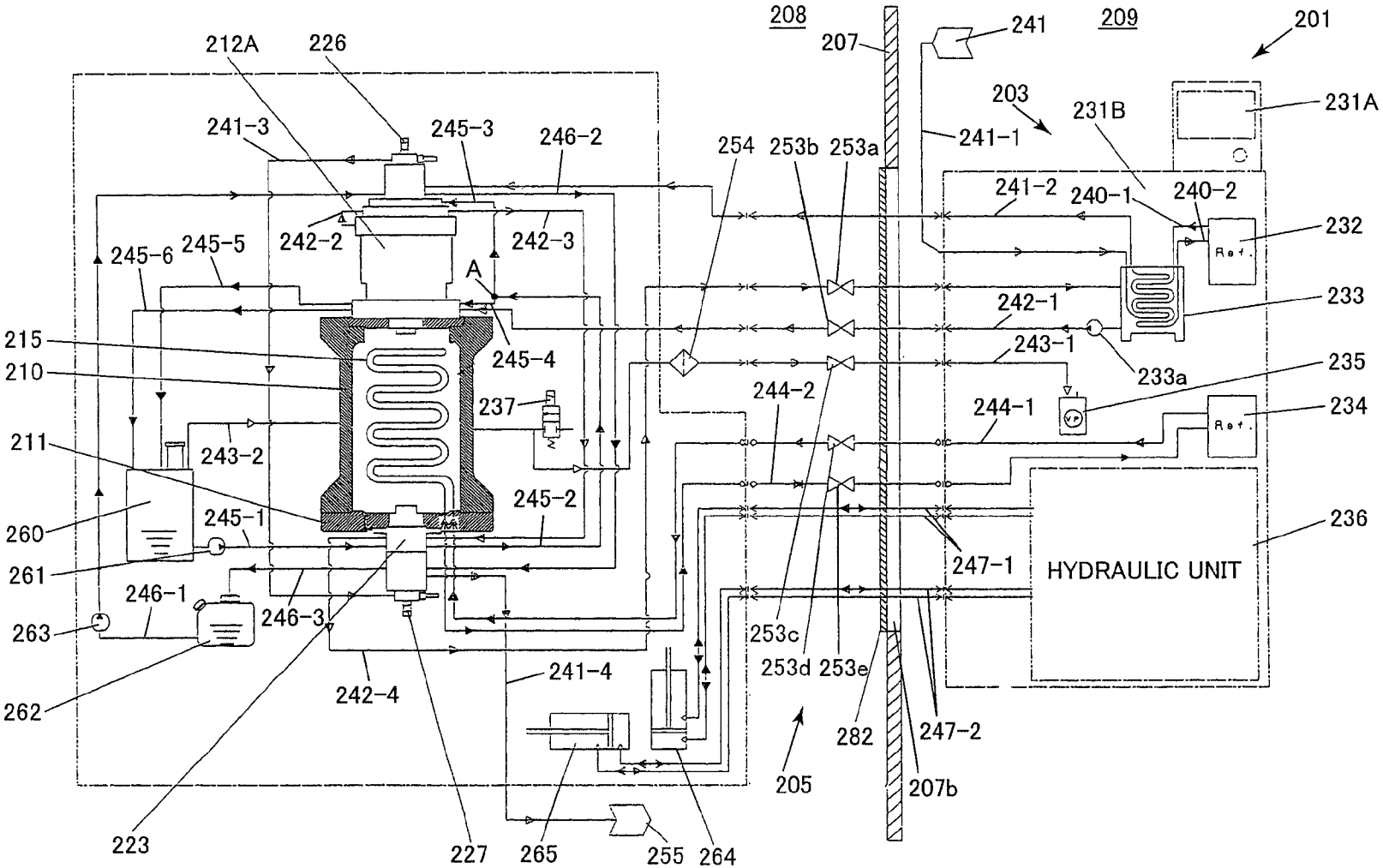
FIG. 7 is an explanatory diagram showing paths along which cooling water, refrigerant, and the like are supplied between the rotator part and the controller part.

Next will be described with reference to FIG. 7 supply paths for supplying cooling water, refrigerant, and oil to the rotator part 202, a decompression mechanism, and a hydraulic path.

The supply unit 231B accommodates: a first cooling machine 232 for supplying a medium to cool cooling water; a cooling tank 233 that uses the medium supplied from the first cooling machine 232 to cool water; the decompression pump 235 for decompressing the chamber 210*a*; a second cooling machine 234 for supplying a refrigerant to the cooling coil 215; and a hydraulic unit 236 for controlling the lift mechanism 213. Since equipment that operates mechanically such as the first cooling machine 232 and the hydraulic unit 236 are installed on the controller room 209 side, microparticles generated from the first cooling machine 232, hydraulic unit 236, and the like can be prevented from being sprayed into the rotator room 208, which is a clean room, and from clogging the filters in the clean room.

The refrigerant supplied from the first cooling machine 232 flows through a first refrigerant channel 240-1 to cool water in the cooling tank 233 and is then recirculated back to the first cooling machine 232 via a second refrigerant channel 240-2.

Cooling water is supplied from a supply source 241. This water flows through a first cooling water channel 241-1 and is temporarily cooled in the cooling tank 233. The cooling water then flows out of the cooling tank 233 to the upper bearing part 212A via a second cooling water channel 241-2. In the upper bearing part 212A, the cooling water cools the mechanical seal 224, which is subject to heat generated through contact with the upper rotating shaft 221. After cooling the mechanical seal 224, the cooling water flows out through the second connector portion 226 and is introduced into the first connector portion 227 via a third cooling water channel 241-3. In the first connector portion 227, the cooling water cools the mechanical seal 225, which is subject to heat generated through contact with the lower rotating shaft 222. After cooling the mechanical seal 225, the cooling water flows out from the lower bearing part 223 along a fourth cooling water channel 241-4 and is discharged from the cooling water outlet 255 into the rotator room 208.

The cooling water is not returned to the controller room 209 because there is a chance that the liquid sample might leak through the mechanical seals 224 and 225 into the cooling water, and it would be dangerous to return cooling water containing the liquid sample to the controller room 209. The discharged cooling water is subjected to an appropriate sterilization process in the rotator room 208 using a sterilization device or the like. The method of sterilization may be heat treatment, or treatment with a solution containing caustic soda (sodium hydroxide), ethanol, formalin, or the like, thereby ensuring the safety of the user of the centrifugal separator 201, as well as the maintenance and repair personnel.

The cooling tank 233 is also connected to a fifth cooling water channel 242-1 for introducing cooling water into the drive part 212. A first pump 233*a* feeds the cooling water through the fifth cooling water channel 242-1. The cooling water flows into the upper bearing part 212A and cools the bottom bearing 212B'. After cooling the bottom bearing 212B', the cooling water is introduced into the annular space 212*a* formed in the upper bearing part 212A to cool the upper bearing part 212A. Next the cooling water flows out from the annular space 212*a* along a sixth cooling water channel 242-2 and again flows into the upper bearing part 212A to cool the top bearing 212B. After cooling the top bearing 212B, the cooling water flows out of the upper bearing part 212A along a seventh cooling water channel 242-3 into the lower bearing part 223. In the lower bearing part 223, the cooling water cools a bearing (not shown) and subsequently flows out of the lower bearing part 223. The cooling water flows into the cooling tank 233 along an eighth cooling water channel 242-4 and, after being cooled in the cooling tank 233, is again supplied to the fifth cooling water channel 242-1.

Here, an emergency stop valve 253*a* is disposed on the rotator room 208 side of the eighth cooling water channel 242-4, and an emergency stop valve 253*b* is disposed on the rotator room 208 side of the fifth cooling water channel 242-1. The emergency stop valves 253*a* and 253*b* are controlled by the controller part 203 to automatically close when the rotor 214 is fractured or separated from the upper rotating shaft 221 and/or the lower rotating shaft 222 in any way. The emergency stop valves 253*a* and 253*b* close automatically when the power supplied thereto is shut down. Accordingly, even if liquid sample leaks from the rotor 214 into the fifth cooling water channel 242-1 or eighth cooling water channel 242-4, these valves can prevent cooling water containing liquid sample from flowing from the rotator room 208 to the controller room 209. Hence, this construction improves the operating safety of the centrifugal separator.

The decompression pump 235 draws air out of the chamber 210*a* via a first decompression pipe 243-1 to create a decompressed state in the chamber 210*a*. At the same time, a first oil tank 260 described later provided in the rotator room 208 is decompressed via a second decompression pipe 243-2. The filter 254 described above is provided on the rotator room 208 side of the first decompression pipe 243-1. When breakage of the rotor 214 or separation of the rotor 214 from the upper or lower rotating shaft 221, 222 occurs in the chamber part 210, the filter 254 traps liquid sample that has been sprayed inside the chamber part 210 and sucked out by the decompression pump 235, preventing the liquid sample from entering the controller room 209. A solenoid valve 237 is disposed on the first decompression pipe 243-1 near the chamber part 210 for introducing air into the chamber 210*a*.

An emergency stop valve 253*c* is provided on the rotator room 208 side of the first decompression pipe 243-1. The emergency stop valve 253*c* is controlled by the controller part 203 to automatically close when breakage of the rotor 214 or separation of the rotor 214 from the upper or lower rotating shaft 221, 222 occurs. The emergency stop valve 253*c* automatically closes when the power supplied thereto is shut down. Accordingly, even if liquid sample leaks out of the rotor 214 and enters the first decompression pipe 243-1, the emergency stop valve 253*c* can prevent air containing this liquid sample from flowing from the rotator room 208 to the controller room 209, thereby improving the operating safety of the centrifugal separator.

A refrigerant cooled in the second cooling machine 234 is supplied through a first refrigerant pipe 244-1 to the cooling coil 215 for cooling the rotor 214. After cooling the rotor 214, the refrigerant is returned to the second cooling machine 234 along a second refrigerant pipe 244-2. The refrigerant is again cooled in the second cooling machine 234 and again supplied to the first refrigerant pipe 244-1 and is recirculated in this way. Emergency stop valves 253*d* and 253*e* are disposed on the rotator room 208 side of the first refrigerant pipe 244-1 and second refrigerant pipe 244-2 respectively. The emergency stop valves 253*d* and 253*e* are controlled by the controller part 203 to automatically close when breakage of the rotor 214 or separation of the rotor 214 from the upper or lower rotating shaft 221, 222 occurs. The emergency stop valves 253*d* and 253*e* automatically close when the power supplied thereto is shut down. Accordingly, even if liquid sample leaks from the damaged rotor 214 into the first refrigerant pipe 244-1 or second refrigerant pipe 244-2, these valves can prevent refrigerant that contains this liquid sample from flowing from the rotator room 208 into the controller room 209, thereby improving the operating safety of the centrifugal separator.

Next, the circulating path for oil used to lubricate the bearings 212B and the like will be described.

The rotator part 202 is provided with the first oil tank 260 and a second oil tank 262. A second pump 261 supplies oil from the first oil tank 260 along a first oil channel 245-1. The oil is supplied to the lower bearing part 223 for lubricating a bearing (not shown) provided therein. After lubricating the bearing, the oil flows along a second oil channel 245-2, branches into a third oil channel 245-3 and a fourth oil channel 245-4 at a branch point A, and is supplied from both channels into the upper bearing part 212A. Oil supplied along the third oil channel 245-3 lubricates the top bearing 212B, while oil supplied along the fourth oil channel 245-4 lubricates the bottom bearing 212B'. The oil that lubricates the top bearing 212B flows out through a fifth oil channel 245-5 and returns to the first oil tank 260, while the oil that lubricates the bottom bearing 212B' flows out through a sixth oil channel 245-6 and returns to the first oil tank 260.

The first oil tank 260 is decompressed by the decompression pump 235 via the first decompression pipe 243-1 and the second decompression pipe 243-2. The first oil tank 260 is decompressed so that bubbles contained in the oil used to lubricate the bearings 212B, 212B' do not expand when entering the decompressed environment in which the bearings 212B, 212B' are provided.

A third pump 263 supplies oil from the second oil tank 262 along a seventh oil channel 246-1. The oil is supplied to the upper bearing part 212A for lubricating the lip seal 212D provided therein. After lubricating the lip seal, the oil is supplied to the lower bearing part 223 via an eighth oil channel 246-2. After lubricating the lip seal 223A in the lower bearing part 223, the oil is returned to the second oil tank 262 along a ninth oil channel 246-3.

The hydraulic unit 236 controls the lift mechanism 213 via first hydraulic channels 247-1 and second hydraulic channels 247-2. The hydraulic unit 236 supplies oil to and withdraws oil from a hydraulic cylinder 264 via the first hydraulic channels 247-1 for raising and lowering the horizontal guide member 213B in the rotator part 202. The hydraulic unit 236 supplies oil to and withdraws oil from a hydraulic cylinder 265 along the second hydraulic channels 247-2 for moving the drive part 212 and rotor 214 forward and backward.

The second cooling water channel 241-2, fifth cooling water channel 242-1, eighth cooling water channel 242-4, first decompression pipe 243-1, first refrigerant pipe 244-1, second refrigerant pipe 244-2, first hydraulic channels 247-1, and second hydraulic channels 247-2 configure the piping part 280, and pass through the partitioning wall 207 while maintaining the airtight quality of the rotator room 208 by using the third sealing member 282.

Hence, if sample is sprayed in the rotator room 208 due to the occurrence of an accident or the like, this construction prevents the sample from entering the controller room 209. The construction also prevents microparticles generated from the first cooling machine 232, hydraulic unit 236, and the like in the controller room 209 from entering the rotator room 208.

Samples used in the centrifugal separator 201 may include the influenza virus, the Japanese encephalitis virus, the whooping cough virus, the AIDS virus, and the hepatitis virus, all of which are extremely harmful to humans, and in the future will include other substances attributed to incurable or contagious diseases. It is noted that a conventional centrifugal separator, such as a "himac CC 40" (trade name) produced by HITACHI KOKI CO., LTD, for example, is used in such a manner that the entire device is installed in an isolated room, such as a decompressed clean room. Therefore, during centrifugation, an operator has to remain in the room to monitor the operating status and perform appropriate measures when abnormalities occur. Although the centrifugal separator may be left temporarily unattended when operating in a normal, stable state, the operator still has to enter the room to check on the operating status. Further, although the operator wears dust-free clothing, rubber gloves, a mask, and protective eyewear for safety, these measures cannot be deemed 100% safe. Contrarily, the centrifugal separator 201 of this embodiment can solve these problems by locating the controller part 203 in the controller room 209 while locating the rotator part 202 in the rotator room 208.

While the invention has been described in detail with reference to specific embodiments thereof, it would be apparent to those skilled in the art that many modifications and variations may be made therein without departing from the spirit of the invention, the scope of which is defined by the attached claims.

For example, while the controller part 40 and second control panel 50 in the first embodiment and the controller 141, second control panel 150, and rotator part 110 in the second embodiment are connected by wire cables, these connections may be implemented wirelessly.

Further, the casing 10 in the first embodiment may be provided with a decompression pump having the same functions as the decompression pump 142 in the second embodiment. In this case, the decompression pump may be connected to the controller part 40 via the signal wire cable 41 and may be connected to the rotor chamber 32 via a decompression hose having the same function as the decompression hose 145 in the second embodiment. The first operating part 21 and the second control panel 50 may be provided with a first decompression switch and a second decompression switch having the same functions as the first decompression switch 136 and second decompression switch 156, respectively. With this construction, the rotor chamber 32 can be decompressed for centrifugation.

In the second embodiment, the signal wire cable 144, power source wire cable 146, and communication wire cable 147 may be provided to pass through the partitioning wall 104, while maintaining the airtight integrity of the partitioning wall 104, in the same manner as the electric wiring part 270 in the third embodiment. Similarly, the decompression hose 145 in the second embodiment may be provided to pass through the partitioning wall 104, while maintaining the airtight integrity of the partitioning wall 104, in the same manner as the piping part 280 in the third embodiment.

In the first embodiment, the first control panel 20 has both the first operating part 21 and the first display unit 22, and the second control panel 50 has both the second operating part 51 and the second display unit 52. However, the first control panel 20 may have at least one of the first operating part 21 and the first display unit 22, and the second control panel 50 may have at least one of the second operating part 51 and the second display unit 52.

Similarly, in the second embodiment, the first control panel 130 has both the first operating part 131 and the first display unit 132, and the second control panel 150 has both the second operating unit 151 and the second display unit 152. However, the first control panel 130 may have at least one of the first operating part 131 and the first display unit 132, and the second control panel 150 may have at least one of the second operating part 151 and the second display unit 152.

What is claimed is:

1. A centrifugal separator comprising:

a rotator part that separates a liquid sample, the rotator part including a rotor and a drive part, the rotor receiving a liquid sample therein and rotating to separate the liquid sample, the drive part driving the rotor to rotate;

a controller part that controls operations of the rotator part;

a rotator casing, in which the rotator part is mounted; and a controller casing separate from the rotator casing, the controller part being mounted in the controller casing, the controller part being connected via a drive wire to the drive part in the rotator part;

wherein the rotor casing is disposed at a clean room and the controller casing is disposed outside the clean room; and wherein the drive wire passes through a wall of the clean room via an air-tight sealing mechanism.

2. The centrifugal separator according to claim 1, wherein the controller part includes a cooling tank that supplies cooling water via a cooling water pipe to the rotator part, the cooling water pipe passing through the wall of the clean room via an airtight sealing mechanism.

3. The centrifugal separator according to claim 2, wherein a cooling water outlet is provided at a portion of the cooling water pipe that is located in the clean room.

4. The centrifugal separator according to claim 2, wherein an emergency stop valve is provided at a portion of the cooling water pipe that is located in the clean room.

5. The centrifugal separator according to claim 1, wherein the rotator part includes a chamber that accommodates the rotor therein, and the controller part includes a decompression pump that a decompresses the chamber; and wherein a decompression pipe connecting the chamber and the decompression pump passes through the wall of the clean room via an airtight sealing mechanism.

6. The centrifugal separator according to claim 5, wherein a filter is provided at a portion of the decompression pipe that is located in the clean room.

7. The centrifugal separator according to claim 5, wherein an emergency stop valve is provided at a portion of the decompression pipe that is located in the clean room.

8. A centrifugal separator, comprising:

a rotator part that is located in a room isolated from outside and that separates a liquid sample, the rotator part including a cylindrical rotor that receives the liquid sample and that rotates to separate the liquid sample, a chamber part that accommodates the rotor therein, and a drive part that drives the rotor to rotate;

a controller part that is disposed outside the room and that controls driving of the drive part;

a rotator-side electric wire that is connected to the rotator part and that has a terminal end;

a controller-side electric wire that is connected to the controller part and that has a terminal end;

a rotator-side connecting part that is mounted on one side of a partitioning wall separating the room from the outside thereof, the one side confronting the room, the terminal end of the rotator-side electric wire being connected to the rotator-side connecting part;

a controller-side connecting part that is mounted on the other side of the partitioning wall, the other side confronting the outside of the room, the terminal end of the controller-side electric wire being connected to the controller-side connecting part; and a connecting cable that is provided in a through-hole formed in the partitioning wall and that electrically connects the rotator-side connecting part with the controller-side connecting part.

9. A centrifugal separator, comprising:

a rotator part that is located in a room isolated from outside and that separates a liquid sample, the rotator part including a cylindrical rotor that receives the liquid sample and that rotates to separate the liquid sample, a chamber part that accommodates the rotor therein, and a drive part that drives the rotor to rotate;

a controller part that is disposed outside the room and that controls driving of the drive part;

a rotator-side pipe that is connected to the rotator part and that has a terminal end;

a controller-side pipe that is connected to the controller part and that has a terminal end; and a pipe-connecting part that passes through a partitioning wall separating the room from the outside thereof, the terminal end of the rotator-side pipe being connected to a rotator-side end of the pipe-connecting part, and the terminal end of the controller-side pipe being connected to a controller-side end of the pipe-connecting part.

10. The centrifugal separator according to claim 9, wherein the rotor part is disposed at a clean room and the controller part is disposed outside the clean room.

11. The centrifugal separator according to claim 10, wherein the control part is connected via a drive wire to the drive part and the drive wire passes through a wall of the clean room via an air-tight sealing mechanism.

* * * * *